US005610469A

United States Patent [19]

Bergman et al.

[11] Patent Number: 5,610,469

[45] Date of Patent: Mar. 11, 1997

[54] ELECTRIC LAMP WITH ELLIPSOIDAL SHROUD

[75] Inventors: Rolf S. Bergman, Cleveland Heights; James T. Dakin, Shaker Heights; Thomas G. Parham, Gates Mills, all of Ohio

[73] Assignee: General Electric Company, Schenectady, N.Y.

[21] Appl. No.: 405,123

[22] Filed: Mar. 16, 1995

[51] Int. Cl.[6] ..... H01J 1/02; H01J 7/24; H01J 61/40; H01J 5/16

[52] U.S. Cl. ..... 313/25; 313/112; 313/113; 313/634; 313/635

[58] Field of Search ..... 313/25, 112, 113, 313/634, 635, 110

[56] References Cited

U.S. PATENT DOCUMENTS

| | | | |
|---|---|---|---|
| 4,709,184 | 11/1987 | Keeffe et al. | 313/638 |
| 4,935,668 | 6/1990 | Hansler et al. | 313/634 |
| 5,039,912 | 8/1991 | Van Vliet et al. | 313/25 |
| 5,043,623 | 8/1991 | Scholz et al. | 313/25 |
| 5,128,589 | 7/1992 | Dakin | 313/634 |
| 5,252,885 | 10/1993 | Muzeroll et al. | 313/25 |
| 5,253,153 | 10/1993 | Mathews et al. | 313/25 |
| 5,296,779 | 3/1994 | Muzeroll | 313/25 |
| 5,422,534 | 6/1995 | Dynys et al. | 313/112 |

OTHER PUBLICATIONS

"Applications of thin film reflecting coating technology to tungsten filament lamps"; IEE Proceedings–A; Bergman, R.S. and Parham, T.G.; vol. 140, No. 6 Nov., 1993; pp. 418–428.

*Primary Examiner*—Sandra L. O'Shea
*Assistant Examiner*—Jay M. Patidar
*Attorney, Agent, or Firm*—George E. Hawranko

[57] ABSTRACT

An electric lamp includes a sealed outer envelope, an arctube located within the envelope, a shroud separate from the arctube having an ellipsoidally-shaped reflecting portion positioned around the arctube, and a coating disposed on the reflecting section of the shroud for reflecting light having predetermined wavelengths emitted by the arctube. The ellipsoidal shape of the shroud is effective for reflecting the light substantially back toward the arctube. Particularly when the coating is a color correcting coating, the shape of the reflecting section is tailored to maximize reflection of radiation at selected wavelengths back toward the arc of the arctube.

17 Claims, 1 Drawing Sheet

ELECTRIC LAMP WITH ELLIPSOIDAL SHROUD

BACKGROUND OF THE INVENTION

1. Field of the Invention

The present invention generally relates to electric lamp assemblies, and more particularly, to electric lamp assemblies having an ellipsoidally-shaped shroud for reflecting light having selected wavelengths back toward the light source.

2. Description of Related Art

Metal halide arc discharge lamps are frequently employed in commercial usage because of their high luminous efficacy and long life. A typical metal halide arc discharge lamp includes a quartz arctube that is hermetically sealed within a glass jacket or outer envelope. The arctube, itself hermetically sealed, has tungsten electrodes press sealed in opposite ends and has a bulb portion containing fill material including mercury, metal halide additives, and a rare gas to facilitate starting. The outer envelope is either evacuated or filled with nitrogen or another inert gas at less than atmospheric pressure.

The metal halide arctube is often surrounded with a shroud which comprises a generally cylindrical tube of light-transmissive material, such as quartz, that is able to withstand high operating temperatures. The arctube and the cylindrical shroud are coaxially mounted within the lamp outer envelope with the arctube located within the shroud. The shroud improves the safety of the lamp by acting as a containment device in the event that the arctube shatters. The shroud allows the lamp outer envelope to remain intact by dissipating the energy of a shattering arctube. Accordingly, a suitable shroud is effective for containing the arctube in such an event.

The shroud can also be used to provide thermal management or color correction. For such thermal management or color correction, a coating is applied to the outer surface of the shroud which is a wavelength selective reflector or absorber. For many applications, however, the cylindrical shape of the shroud is not ideal from an optical point of view.

In the thermal management or heat conserving application, it is desirable for the coating to reflect substantially all non visible radiation back to the arc region were it is absorbed to increase the efficiency of the lamp. When the coating is located on the cylindrical shroud, however, a substantial portion of the emitted radiation is not reflected back to the arc region. A substantial portion of the emitted radiation is reflected out ends of the cylindrical shroud. For example, when the arc length is about 11 mm and the outer diameter of the cylindrical shroud is about 17 mm, about 35–40 percent of the emitted radiation is reflected back to the arc region while the remainder is lost through the ends.

In the color correction application, it is desirable for the coating to reflect some of the visible light to alter the color of the light emitted from the lamp. The light emitted through the shroud has the desired color properties. However, as stated above, over 60 percent of the light leaves through the ends of the shroud causing color separation. The result is a very large color shift in the light output as one changes orientation with respect to the arc axis. That is, light coming from the ends has a very different color than that coming from the center. Depending on the lighting fixture, this can cause different colors in different portions of the reflected light.

The coating could alternatively be located on outer surface of the arctube which is often ellipsoidally-shaped and may be an ideal location from an optical point of view but wall temperatures of up to about 900 degrees centigrade during operation are too high for many coatings. Additionally, processing considerations make the outer surface of the arctube a less desirable location than the shroud for a color correcting coating. High index materials used in the optical coatings may be unstable at arctube temperatures. For example, $TiO_2$ becomes foggy due to optical scattering as the film transforms from anatase to rutile crystal phase. For a discussion of this phenomenaee see U.S. Pat. No. 4,891,542, the disclosure of which is expressly incorporated herein in its entirety by reference. Additionally, $Ta_2O_5$, $TiO_2$, and $Nb_2O_5$ all darken due to oxygen vacancy formation, causing optical absorption. For a discussion of this phenomena see Applications of Thin Film Reflecting Coating Technology to Tungsten Filament Lamps, IEE Proceedings-A, Vol. 140, No. 6, November, 1993.

The coating could also be alternatively located on an outer surface of the outer envelope which is often ellipsoidally-shaped. The outer envelope, however, is not a good location for a coating because a relatively large amount of coating material is required, optical considerations limit the amount of radiation which can reliably be reflected back to the arctube, considerations other than optics may dictate the shape of the outer envelope, and the outer surface of the outer envelope is a hostile environment for a reflective coating. Accordingly, there is a need in the art for an improved lamp assembly that reflects selected radiation substantially back to the arctube.

SUMMARY OF THE INVENTION

The present invention provides an improved electric lamp assembly which solves the above-noted problems found in the related art. In accordance with the present invention, an electric lamp is provided that includes a sealed light-transmissive lamp envelope, a light source capable of generating light within the envelope, a shroud separate from the light source and having a reflecting section disposed about the light source, and a coating disposed on the reflecting section for reflecting light having predetermined wavelengths emitted by the light source. The reflecting section has an ellipsoidal shape effective for reflecting the light having the predetermined wavelengths back toward the light source.

The elliptical shroud provides a significant improvement in the amount of reflected light that is returned to the arc region. In the above example, where the arc length is about 11 mm and the outer diameter of the cylindrical shroud is about 17 mm, about 90 percent of the emitted radiation is reflected back to the arc region when the foci of the shroud ellipse are positioned at the electrodes of the arctube. Therefore, where the coating is a heat preserving filter, a greater efficacy is obtained because substantially all the emitted nonvisible radiation is reflected back to the arc. Furthermore, where the coating is a color correcting filter, no color separation is observed because substantially all of the light is refocused through the arc. Preferably, at least 50 percent of the emitted radiation is reflected back to the arc region, more preferably at least 60 percent, even more preferably at least 70 percent, even more preferably 80 percent, and most preferably at least 95 percent.

BRIEF DESCRIPTION OF THE DRAWINGS

These and other features and advantages of the present invention will be apparent with reference to the following description taken in conjunction with the accompanying drawings, wherein.

DETAILED DESCRIPTION OF THE PREFERRED EMBODIMENT

Figure 1:
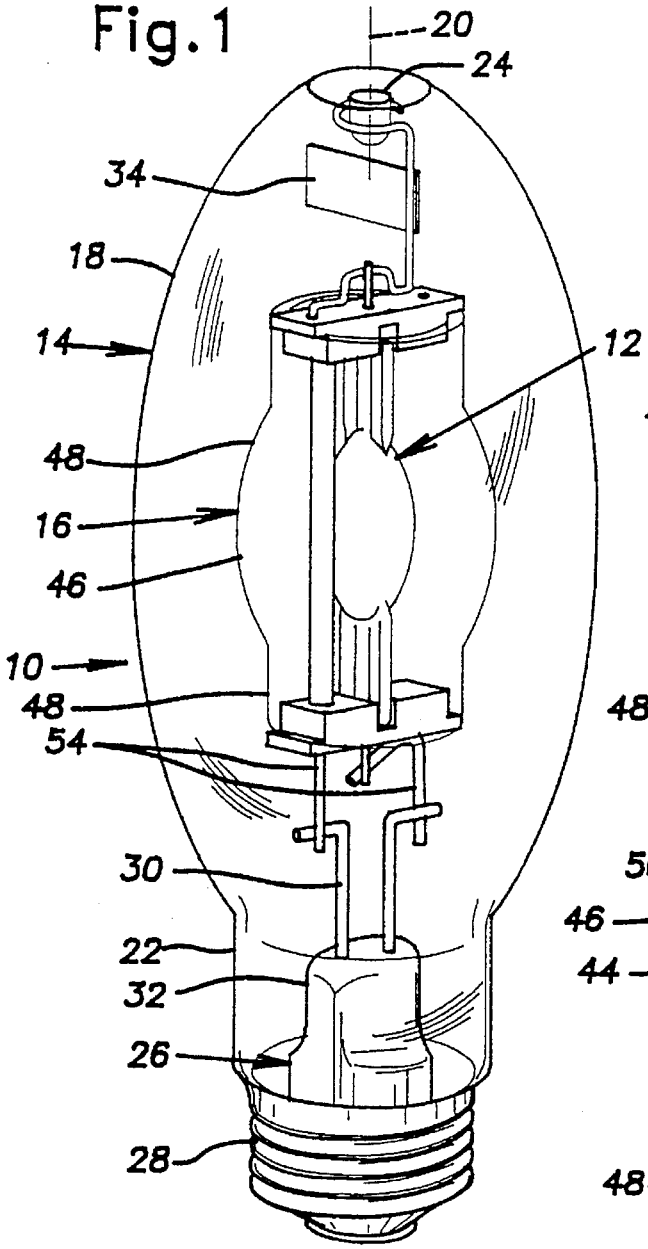
FIG. 1 is a perspective view of a lamp assembly in accordance with a preferred embodiment of the invention.

An electric lamp assembly 10 in accordance with a preferred embodiment of the invention is shown in FIG. 1. The lamp assembly 10 is a metal halide arc discharge lamp and includes an arctube 12, a bulb or outer envelope 14, an ellipsoidal shroud 16, and a reflective coating 50 (FIG. 2) on the shroud 16. The outer envelope 14 has a main or dome portion 18 elongated along a central axis 20 and a neck portion 22. The dome portion 18 has a dimple 24 along the central axis 20 at the upper end of the outer envelope 14 (as viewed). The neck portion 22 has an inside diameter generally perpendicular to the central axis 20. The outer envelope 14 is formed of a light transmissive material and is typically formed of a blow molded hard glass such as borosilicate.

The outer envelope 14 is hermetically sealed with a glass stem 26 which extends into the neck portion 22 along the central axis 20. A base 28, formed for easy connection to an electrical source, is fixed to the outer envelope 14. A pair of electrical conductors or stem leads 30 pass through the stem 26 and are sealed by a stem press 32 as is known in the art. The stem leads 30 are electrically connected to the base 28 external of the outer envelope 14 to provide access for energization of the lamp assembly 10.

Additionally, a zirconium aluminum getter 34 is positioned within and at the upper end of the outer envelope 14 (as viewed) generally adjacent the dimple 24. As is well known, getters are important in any structure wherein an evacuated or inert gas environment is present. It should be noted, however, that an oxygen donating getter such as Ba peroxide must be used if the shroud reaches temperatures greater than about 500 degrees C. and reflective coatings such as $Ta_7O_5$, $TiO_2$, or $Nb_2O_5$ are present to prevent darkening of the reflective coatings. U.S. Pat. No. 4,891,542, the disclosure of which is expressly incorporated herein in its entirety by reference, discloses the use of an oxygen donating getter to prevent darkening of reflective coatings. It should also be noted that a Si nitride reflective coating does not require this special getter.

Figure 2:
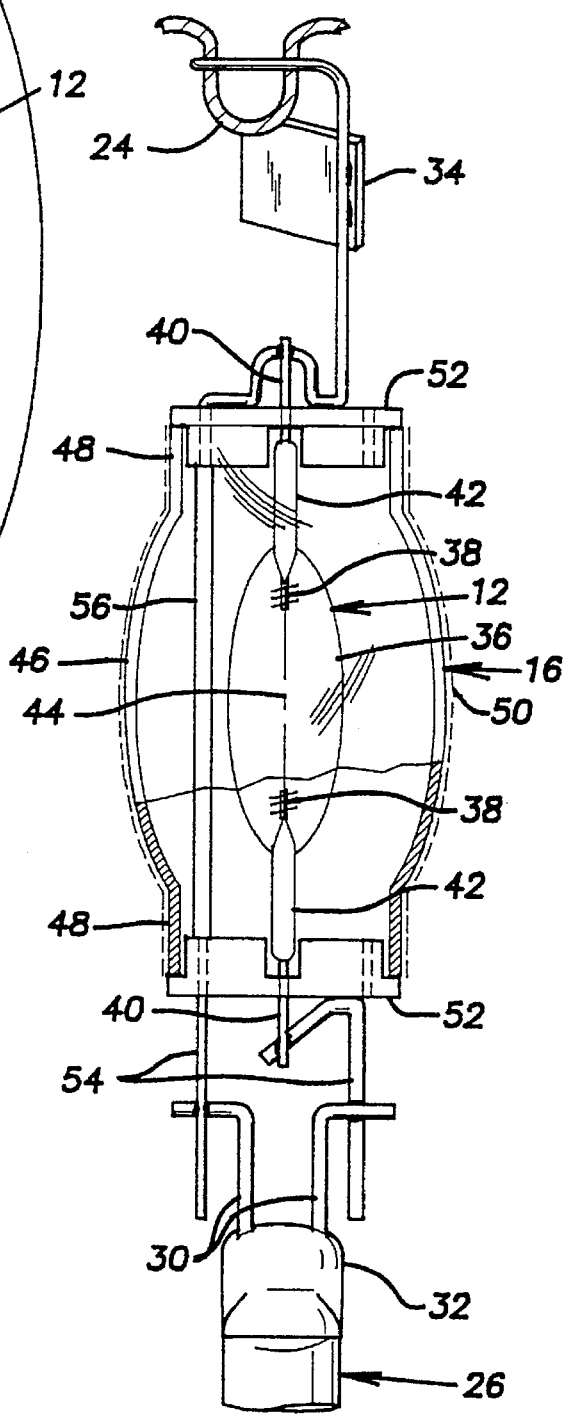
FIG. 2 is an enlarged elevational view, in partial cross section, of an arctube and a shroud of the lamp assembly of FIG. 1.

As best seen in FIG. 2, the arctube 12 is disposed within the outer envelope 14 substantially parallel to the outer envelope central axis 20. The arctube 12 includes a bulb portion 36, two electrodes 38, two electrode leads 40, and two pinch or press seals 42. The bulb portion 36 encloses a sealed arc discharge zone 44 which contains a suitable fill material for maintaining an arc discharge between the electrodes 38 which are positioned at opposite ends of the arc discharge zone 44. The press seals 42 are located at opposite ends of the bulb portion 36 and seal the electrode leads 40 to provide sealed electrical feed-throughs to the electrodes 38. The arctube 12 is made of a light-transmissive and heat-resistant material such as quartz.

While the light source of the preferred embodiment is a metal halide arctube, it will be noted that other types of high intensity discharge or halogen light sources could be utilized for other lamp applications.

The shroud 16 has an ellipsoidally-shaped reflecting section 46 and cylindrically-shaped end sections 48 which are hollow to form an interior space. Each end of the shroud 16 is generally open so that the interior space of the shroud 16 is unsealed, that is, the interior space of the shroud 16 is in fluid communication with the interior space of the outer envelope 14 for maintaining the shroud 16 at a relatively low temperature. The shroud 16 is supported within the outer envelope 14 substantially parallel to the outer envelope central axis 20 and generally coaxial with the arctube 12. The arctube 12 is positioned within the interior space of the shroud 16 such that the reflecting portion 46 of the shroud 16 surrounds the bulb portion 36 of the arctube 12. Positioned in this manner, the shroud 16 is separate from the arctube 12, that is, there is no glass to glass contact or glass path for heat to be transferred from the arctube 12 to the shroud 16. Preferably, the shroud 16 is positioned and supported for effective thermal separation from the arctube 12 to provide a shroud temperature lower than an arctube temperature.

The reflecting portion 46 of the shroud 16 is sized and shaped such that light emitted by the arctube 12 and reflected by the reflecting portion 46 is substantially reflected back toward the arctube 12, and more preferably, back toward the bulb portion 36 of the arctube 12. The size and shape of the shroud 16 is preferably tailored to maximize the reflection of the desired radiation back to the arctube or the bulb portion 36 of the arctube 12. Particularly when the coating 50 is a color correcting coating, the shape of the reflecting section 46 is tailored to maximize reflection of the desired radiation back toward the arc or arc discharge zone 44 of the arctube 12. Therefore, it is desirable for the foci of the shroud ellipse to be positioned at the electrodes 38.

The shroud 16 is made of a light-transmissive and heat-resistant material such as quartz, borosilicate, or alumino silicate glass. The reflecting portion 46 and the end sections 48 can be formed by blow molding a piece of quartz or glass tubing.

The reflecting portion 46 of the shroud 16 has an outer diameter less than the inner diameter of the neck portion 22 of the outer envelope 14 so that the shroud 16 can be inserted into the outer envelope 14 during manufacturing of the lamp assembly 10. The shroud 16 preferably has a length greater than the distance between the outer ends of the arctube press seals 42 and less than the distance between the outer ends of the arctube electrode leads 40.

It will be noted that in some lamp applications it may be desirable to position the shroud on the outside of an outer envelope. For example, a shroud can be positioned over a filament tube of a glass halogen lamp. The external shroud can be formed from alumino silicate glass to reduce cost, or formed from quartz if a higher temperature material is required.

A coating 50 is disposed on an inner or outer surface of the shroud 16 for reflecting light emitted by the arctube having wavelengths normally transmitted by the shroud 16. The coating 50 is applied to the shroud 16 to selectively reflect and transmit various portions of the electromagnetic spectrum. The coating 50 can be a thermal management coating that is transparent to visible radiation but reflects ultraviolet and/or infrared radiation to increase the temperature of the arctube 12 and thereby increase the efficacy of the light source. The coating 50 can also be a color correcting coating that reflects portions of visible radiation to alter the color of the light projected or output from the lamp assembly. The coating 50 must be capable of withstanding the wall temperature of the shroud 16 during operation of the lamp 10 which is relatively low compared to the wall temperature of the arctube 12. Additionally, the coating 50 must be compatible with the material of the shroud.

The coating 50 is preferably an optical interference filter made of alternating layers of refractory metal oxides having high and low indexes of refraction, such coatings being known in the art. Refractory metal oxides are used because they are able to withstand relatively high temperatures. Such oxides include, for example, titania, hafnia, tantala, and niobia for the high index of refraction material and silica or magnesium fluoride for the low index of refraction material. Materials with an intermediate index of refraction such silicon nitride and aluminum oxide may be used either for the high or low index material. A desirable property of an optical interference filter is that it can be designed to reflect either infrared light, or an undesirable color of visible light. This is accomplished by selecting layer thicknesses and layer count for a given set of high and low index of refraction materials, as is known in the art. A preferred thermal management coating is formed by depositing alternating layers of tantala and silica by any well known deposition process. A preferred color correcting coating is also formed by depositing alternating layers of tantala and silica by any well known deposition process.

It will be noted that other types of reflective coatings known in the art could be utilized. For example, an ultraviolet reflecting coating could be utilized.

Means for supporting the arctube 12 and the shroud 16 includes two insulator stops 52, and two conductor wires 54. The stops 52 are positioned at opposite ends of the shroud 16 such that axially facing surfaces of the stops limit axial movement of the shroud 16 and laterally facing surfaces of the stops 52 limit radial movement of the shroud 16. The stops are preferably made from an insulating material such as a high temperature ceramic like aluminum oxide. One of the conductor wires 54 extends from one of the stem leads 30 to the upper one of the electrode leads 40 and the dimple 24 of the outer envelope 14. The other conductor wire 54 extends from the other stem lead 30 to the lower one of the electrode leads 40. The conductor wires 54 engage outer surfaces of the stops 52 to retain the shroud 16 therebetween. Supported in this manner, the shroud 16 is separate and insulated from the arctube 12.

The conductors wires 54 also electrically couple the stem leads 30 to the electrode leads 40. Therefore, at least a portion of the conductor wire 54 passing through the interior space of the shroud 16 is preferably surrounded by an insulator sleeve 56 for electrically insulating the conductor wire 54 to limit interaction between the conductor wire 54 and the arctube 12.

It will be noted that other means for mechanically supporting and/or electrically coupling the arctube and shroud could be utilized such as, for example but not limited to, a pair of clips or rings with a support rod and a flying lead or electrode support. See U.S. Pat. Nos. 5,270,608, 5,252,885, 5,122,706, 4,963,790, 5,043,623, 5,039,921, 5,023,506, 4,709,184, the disclosures of which are expressly incorporated herein in their entirety by reference, for examples of coupling and support means of arctubes and shrouds.

EXAMPLE 70 watt metal halide lamps similar to that shown in FIGS. 1 and 2 were built and tested. The fused quartz shroud 16 had an ellipsoidally-shaped reflecting section 46 whose external shape-was described by an ellipse of minor diameter 21 mm and foci separation of 11 mm rotated about its major axis. The cylindrically shaped end sections 48 had an external diameter of 17 mm, and the wall thickness was 1.5 mm. The coating applied to the shroud was a 46 layer $Ta_2O_5$—$SiO_2$ infrared-reflecting and visible-transmitting filter.

The fused quartz arctube 12 had a bulb portion 36 whose external shape was described by an ellipse of minor diameter 8.9 mm and major diameter 16.5 mm rotated about its major axis. The two electrodes had a nominal tip separation of 10.3 mm. The arctubes were dosed with 4.1 mg of mercury plus 11 mg of either a sodium iodide-scandium iodide mixture or a sodium iodide-dysprosium iodide mixture. Control lamps were made in which the shroud was a straight piece of quartz tubing without a reflective coating.

Photometric data was measured after 100 hours of burning to be as follows:

| Dose | Shroud | Lumens | Tcolor | Ra | |
|---|---|---|---|---|---|
| Na—Sc | straight/uncoated | 5121 | 3205 | NA | ave. |
| | | 268 | 156 | | sigma |
| Na—Sc | ellipsoidal/coated | 4763 | 2863 | NA | ave. |
| | | 314 | 156 | | sigma |
| Na—Dy | straight/uncoated | 5031 | 3533 | 75 | ave. |
| | | 569 | 147 | | sigma |
| Na—Dy | ellipsoidal/coated | 5545 | 3000 | 80 | ave. |
| | | 372 | 142 | | sigma |

The ellipsoidal coated shroud provided a way to adjust lamp performance without altering the arctube. For the sodium iodide-dysprosium iodide dose, whose performance is dependent on arctube temperature, the ellipsoidal/coated shroud had the beneficial effect of increasing the lumen output and the color rendering index (Ra). At the same time it reduced the color temperature (Tcolor) to the desirable 3000 K range. For the sodium-iodide-scandium iodide dose, the ellipsoidal/coated shroud had an undesirable effect of decreasing the lumen output on this particular arctube design. However, it reduced the color temperature (Tcolor) closer to the desirable 3000 K range.

Although a particular embodiment of the invention has been described in detail, it will be understood that the invention is not limited correspondingly in scope, but includes all changes and modifications coming within the spirit and terms of the claims appended hereto.

What is claimed is:

1. An electric lamp comprising:

a sealed light-transmissive lamp envelope having an interior space;

a light source capable of generating light within said envelope;

a shroud separate from said light source and in non-sealing communication with said light source and having a reflecting section disposed about said light source, said reflecting section being separated from said light source by a separating space;

a coating disposed on said reflecting section of said shroud for reflecting light having predetermined wavelengths emitted by said light source; and wherein said reflecting section has an ellipsoidal shape effective for reflecting said light having predetermined wavelengths back substantially toward said light source and wherein said separating space is in fluid communication with said interior space of said envelope, said ellipsoidal shape of said reflecting section having a major longitudinal axis, said ellipsoidal shape being uniform such that if two halves of said ellipsoidal shape are defined by a plane in the middle of the reflecting section, said plane being perpendicular to said axis, said two halves will be mirror images of one another.

2. The lamp according to claim 1, wherein said shroud is disposed within said envelope, wherein said light source is centrally located within the space defined by said reflecting section, and wherein said reflecting section has a longitudinal axis and said light source has a longitudinal axis and said two axes are coincident.

3. The lamp according to claim 1, said shroud defining and having an interior space, said shroud having generally open ends and the interior space of the shroud being in fluid communication with the interior space of the envelope.

4. The lamp according to claim 1, said shroud having cylindrically-shaped end sections.

5. The lamp according to claim 4, said lamp having a base, said lamp further comprising supporting means for supporting said shroud about said light source, said supporting means cooperating with said cylindrically-shaped end sections of said shroud and with said base.

6. The lamp according to claim 1, wherein said coating reflects a portion of visible radiation emitted by said light source for correcting color of light output from said lamp.

7. The lamp according to claim 6, wherein said coating is an optical interference filter made of alternating layers of tantala and silica.

8. The lamp according to claim 1, wherein said coating reflects infrared radiation emitted by said light source for raising a temperature of said light source and thereby increasing its efficacy.

9. The lamp according to claim 8, wherein said coating is an optical interference filter made of alternating layers of tantala and silica.

10. The lamp according to claim 1, wherein said light source is a metal halide arctube having a bulb portion surrounding an arc discharge zone.

11. The lamp according to claim 10, wherein said reflecting section of said shroud is effective for reflecting said light having the predetermined wavelengths substantially back toward said bulb portion of said arctube.

12. The lamp according to claim 11, wherein said shroud is a quartz shroud.

13. The lamp according to claim 12, wherein said shroud is disposed within said envelope and has cylindrically-shaped end sections.

14. The lamp according to claim 13, wherein said end sections have generally open ends.

15. The lamp according to claim 14, said lamp having a base, said lamp further comprising supporting means cooperating with said end sections and with said base for supporting said shroud about said metal halide arctube and within said envelope.

16. The lamp according to claim 15, wherein said coating reflects a portion of visible radiation emitted by said light source for correcting color of light output from said lamp.

17. The lamp according to claim 16, wherein said reflecting section of said shroud is effective for reflecting said light having the predetermined wavelengths substantially back toward said arc discharge zone of said arctube.

* * * * *